United States Patent [19]

Shiba et al.

[11] Patent Number: 4,546,573

[45] Date of Patent: Oct. 15, 1985

[54] GRINDING MACHINE

[75] Inventors: Kazuo Shiba; Shigehiro Fuwa, both of Tokorozawa, Japan

[73] Assignee: Citizen Watch Co., Ltd., Tokyo, Japan

[21] Appl. No.: 631,228

[22] Filed: Jul. 16, 1984

[30] Foreign Application Priority Data

Jul. 25, 1983 [JP] Japan ..... 58-135464

[51] Int. Cl.[4] ..... B24B 49/12

[52] U.S. Cl. ..... 51/165.72; 51/165.71; 51/216 A; 51/217 A; 51/235

[58] Field of Search ..... 51/165.72, 165 R, 165.77, 51/165.71, 235, 216 A, 217 A

[56] References Cited

U.S. PATENT DOCUMENTS

| | | | |
|---|---|---|---|
| 2,145,116 | 1/1939 | Howard | 51/165.72 |
| 2,326,319 | 8/1943 | Bailey | 51/165.72 |
| 3,197,921 | 8/1965 | Hohler | 51/103 R |
| 3,552,069 | 1/1971 | Butler | 51/165.93 |
| 4,268,999 | 5/1981 | Noto | 51/165.72 |

*Primary Examiner*—Harold D. Whitehead
*Attorney, Agent, or Firm*—Koda and Androlia

[57] ABSTRACT

A grinding machine including optical detectors for detecting an inclination and a difference of a reference position of the workpiece with respect to a reference position of the grinding machine; an inclinable jig capable of inclining the reference position of the workpiece; controlling members for rotating the inclinable jig; displacement detectors for detecting an inclination of the inclinable jig; and a controlling device for calculating the correction amount of the reference position of the workpiece according to the position information from the optical detectors, providing the control signal to the controlling members in accordance with the calculated value to rotate the inclinable jig, simultaneously receiving the information from the displacement detectors, rotating the inclinable jig until the information from the displacement detectors coincides with the calculated value, and holding the jig. The inclinable jig includes an inclinable member supported rotatably by hydrostatic pressure pads and is capable of finely adjusting and setting the position of the workpiece to be ground.

9 Claims, 13 Drawing Figures

(A)

(B)
340
341
342
372
330
332
331
3
218
238a
238b
237
2

(C)

GRINDING MACHINE

BACKGROUND OF THE INVENTION

1. Field of the Invention

This invention relates to a grinding machine and more particularly to a grinding machine capable of finely adjusting and setting the surfaces of workpieces to be ground.

2. Description of the Prior Art

The ends of a workpiece are often required to be ground parallel with the reference position of the workpiece with a considerable degree of accuracy. For example, when grinding the magnetic head of a magnetic recorder, it is necessary to grind the gap depth, that is, pole height thereof to a level. As shown in FIGS. 6 and 7, a surface 24*a* is required to be ground parallel to the reference surface connecting P to P of the magnetic head blank, that is, with all the distances from the reference surface kept constant.

Conventionally, however, when grinding a workpiece to such a shape, the workpiece is held with some inclination in an inclined jig. As a result, the operating efficiency is very low. Furthermore, any fine adjustment of inclination cannot be made. This makes it difficult to finish a product with a high parallelism as required, much less to measure and grind workpieces automatically.

This invention basically eliminates the above-mentioned prior art drawbacks and overcomes the limits of the prior art. It is therefore an object of the invention to provide a grinding machine capable of finely adjusting and setting the position of a workpiece to be ground. It is a further object of the invention to provide a grinding machine capable of performing the automatic adjustment, setting and grinding of a workpiece sequentially.

SUMMARY OF THE INVENTION

These objects of the invention are achieved by providing a grinding machine comprising a grinding attachment for grinding a workpiece; an optical detector for detecting an inclination and a difference of a reference position of the workpiece with respect to a reference position of the grinding machine; and inclinable jig for holding the workpiece and capable of inclining the reference position of the workpiece; moving means for mounting the inclinable jig thereon and capable of traveling between the optical detector and the grinding attachment; a controlling member for providing a rotary force to the inclinable jig and rotating the same; and a controlling device for sending a control signal to the controlling member and sending other control signals to the moving means and the grinding attachment; the controlling device calculating a correction amount of the reference position of the workpiece according to the position information from the optical detector, providing the control signal to the controlling member in accordance with the calculated value to rotate and hold the inclinable jig, and traveling the moving means, whereby after the reference position of the workpiece is located and a surface to be ground with respect to the reference position of the workpiece is set, the moving means are traveled and the grinding attachment grinds the workpiece; and further providing by a grinding machine comprising a grinding attachment for grinding a workpiece; an optical detector for detecting an inclination and a difference of a reference position of the workpiece with respect to a reference position of the grinding machine; an inclinable jig for holding the workpiece and capable of inclining the reference position of the workpiece; moving means for mounting the inclinable jig thereon and capable of traveling between the optical detector and the grinding attachment; a controlling member for providing a rotary force to the inclinable jig and rotating the same; a controlling device for sending a control signal to the controlling member and sending other contorl signals to the moving means and the grinding attachment; and a displacement detector for detecting an inclination of the inclinable jig; the controlling device calculating the correction amount of the reference position of the workpiece according to the position information from the optical detector, providing the control signal to the controlling member in accordance with the calculated value to rotate said inclinable jig, simultaneously receiving the information from the displacement detector for detecting an inclination of the inclinable jig, rotating the inclinable jig until the information from the displacement detector coincides with the calculated value and holding the jig, and traveling the moving means, whereby after the reference position of the workpiece is positioned and the level of the surface to be ground with respect to the reference position of the workpiece is set, the moving means are traveled and the grinding attachment grinds the workpiece.

BRIEF DESCRIPTION OF THE DRAWINGS

FIG. 2 (B) is a cross-sectional view showing the essential portion of a hydrostatic pressure nut;

FIG. 2 (C) is a cross-sectional view showing the essential portion of a hydrostatic pressure table;

DETAILED DESCRIPTION OF THE PREFERRED EMBODIMENT

Figure 1:
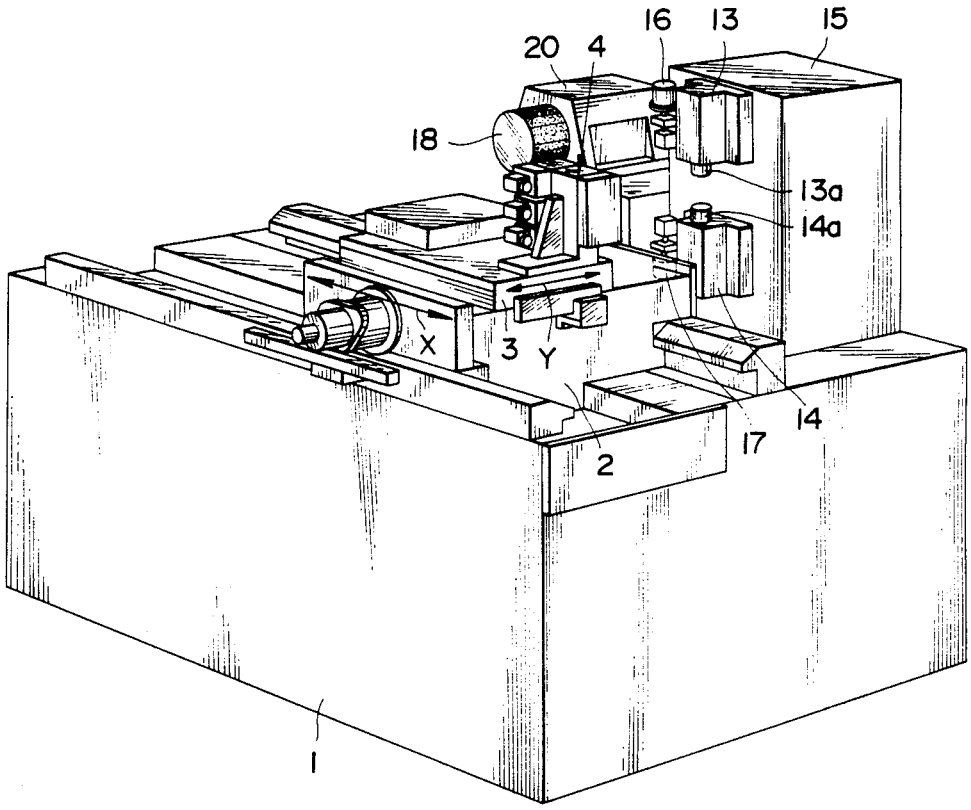
FIG. 1 is a perspective view showing a grinding machine of the invention.

As shown in FIG. 1, an X-axis feed table 2 and a Y-axis feed table 3 on the X-axis feed table 2 are slidably mounted on a bed 1, and both tables are fed respectively along guide grooves by feed screws (not shown) connected to motors. On the Y-axis feed table 3 is mounted an inclinable jig 4 which is designed to hold a workpiece in a part thereof. Furthermore, on the bed 1, optical detectors of charge-coupled device (CCD) television cameras 13, 14 with a pair of upper and lower microscopes 13*a*, 14*a* respectively are movably supported in the vertical direction on a column 15 and can be moved in the vertical direction along guide grooves by respective pulse motors 16, 17 in order to get the focus of the workpiece. The column 15 is also provided with a grinding attachment 20 loaded with a grinding wheel 18.

Figure 2:
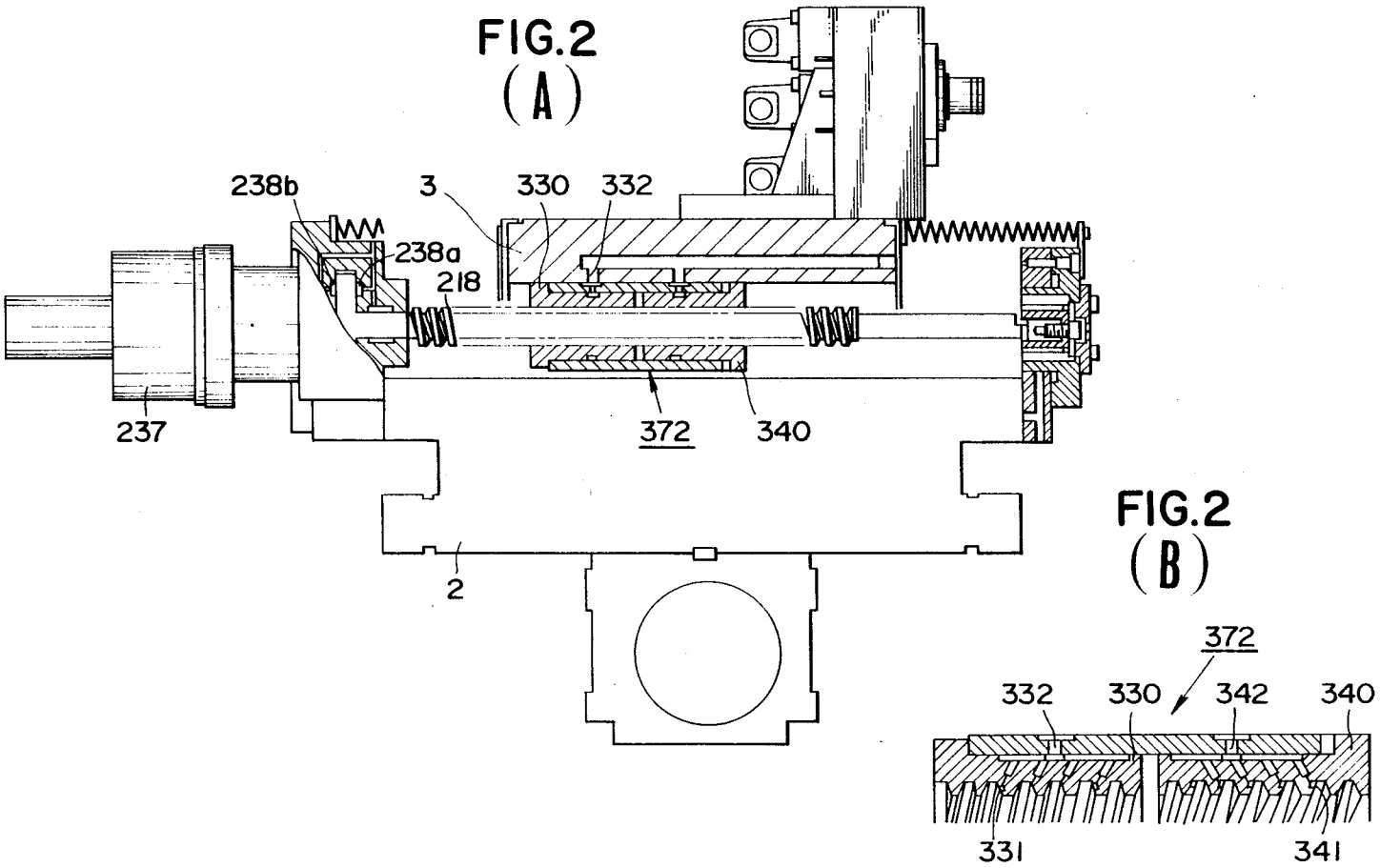
FIG. 2 (A) is a cross-sectional view showing the essential portion of a hydrostatic pressure feed screw.
Figure 2:
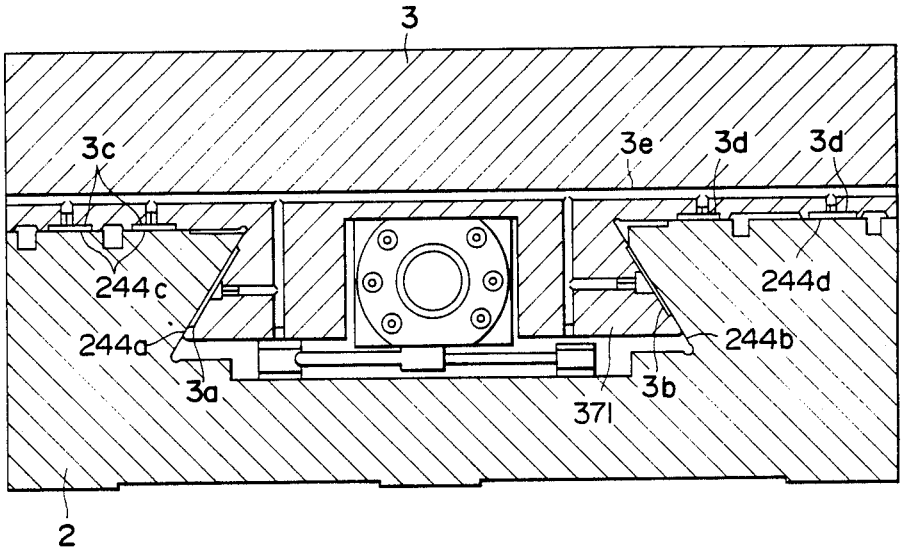

The basic structure of the hydrostatic pressure feed mechanism used in the Y-axis feed mechanism is shown in an explanatory view in FIG. 2. As will be noted from this figure, the hydrostatic pressure feed mechanism includes a hydrostatic pressure nut 372 which is fixed to the Y-axis feed table 3. This hydrostatic pressure nut 372 consists of a pair of female screws 330, 340 fixed adjacent to and along a hydrostatic pressure feed screw 218 fixed on the X-axis feed table 2 and hydrostatic pressure pockets 331, 341 which open onto opposite screw faces of the hydrostatic pressure feed screw 218. The hydrostatic pressure nut 372 is integrally fixed to the Y-axis feed table 3 and is driven by the rotation of the hydrostatic pressure feed screw 218. The hydrostatic pressure pockets 331, 341 are supplied with hydraulic pressure by the hydraulic pressure unit (not shown) through hydraulic pressure lines 332, 342. Reference numerals 238*a* and 238*b* denote hydrostatic pressure pockets which together constitute a hydrostatic pressure thrust bearing for stabilizing the operation of the hydrostatic pressure feed screw 218.

Furthermore, a sliding member 371 of the Y-axis feed table 3 is mounted on the X-axis feed table 2 having a first trapezoidal groove in such a manner as to be guided by the inclined lateral surfaces 244*a*, 244*b* of the first trapezoidal groove. That is to say, the Y-axis feed table is guided by four surfaces of the X-axis feed table 2. At each engagement region between the X-axis feed table 2 and the Y-axis feed table 3 is provided one or more rows of hydrostatic pressure pockets 3*a*, 3*b*, 3*c* and 3*d*. A fluid delivered under pressure from an external hydrostatic fluid pressure source (not shown) in the X-axis feed table 2, a pantograph fluid pressure line adapted to expand and contract with the travel of the sliding table 3 and a fluid pressure line 3*e* in the table to be supplied to the hydrostatic bearing, whereby force is generated at each of the surfaces 244*a*, 244*b*, 244*c* and 244*d*.

As the above explanation with respect to the hydrostatic pressure feed mechanism for the Y-axis feed table 3 applies as well to that for the X-axis feed table 2, an explanation of this latter mechanism will not, in the interest of brevity, be given here.

The X-axis hydrostatic pressure feed screw (not shown) and the Y-axis hydrostatic pressure feed screw 218 are driven via associated transmission mechanisms by an X-axis drive motor (not shown) and a Y-axis drive motor 237 respectively, and both screws are supported with high precision in both the radial and thrust directions by hydrostatic bearings.

Thus, the use of the hydrostatic guides and hydrostatic pressure feed screws of the moving means (X-axis and Y-axis feed tables) makes a fine travel and positioning possible and enhances repeatability and reproducibility. Furthermore, the noncontact bearings provide improved durability.

Figure 3:
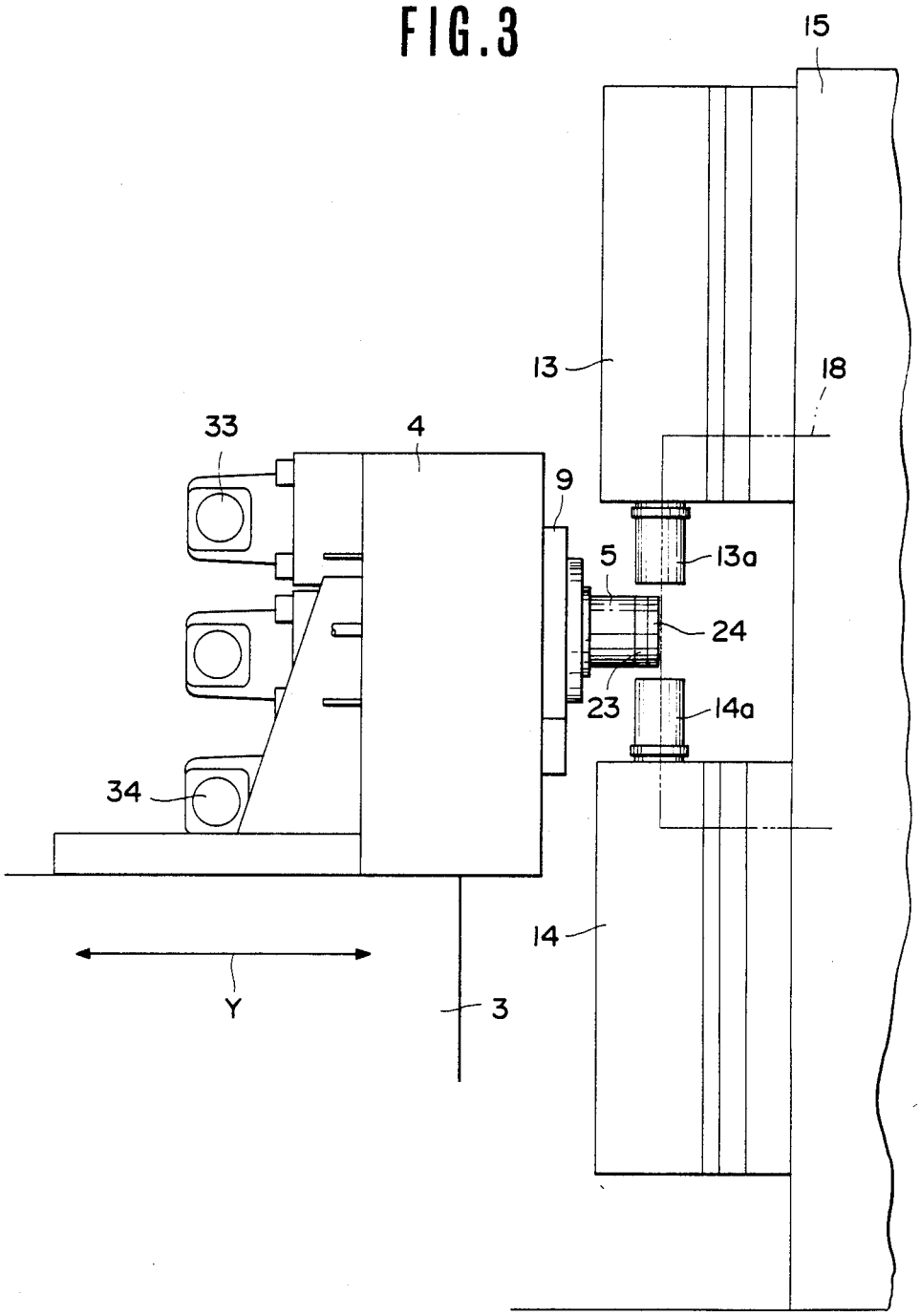
FIG. 3 is a side view showing an inclinable jig and optical detectors.
Figure 4:
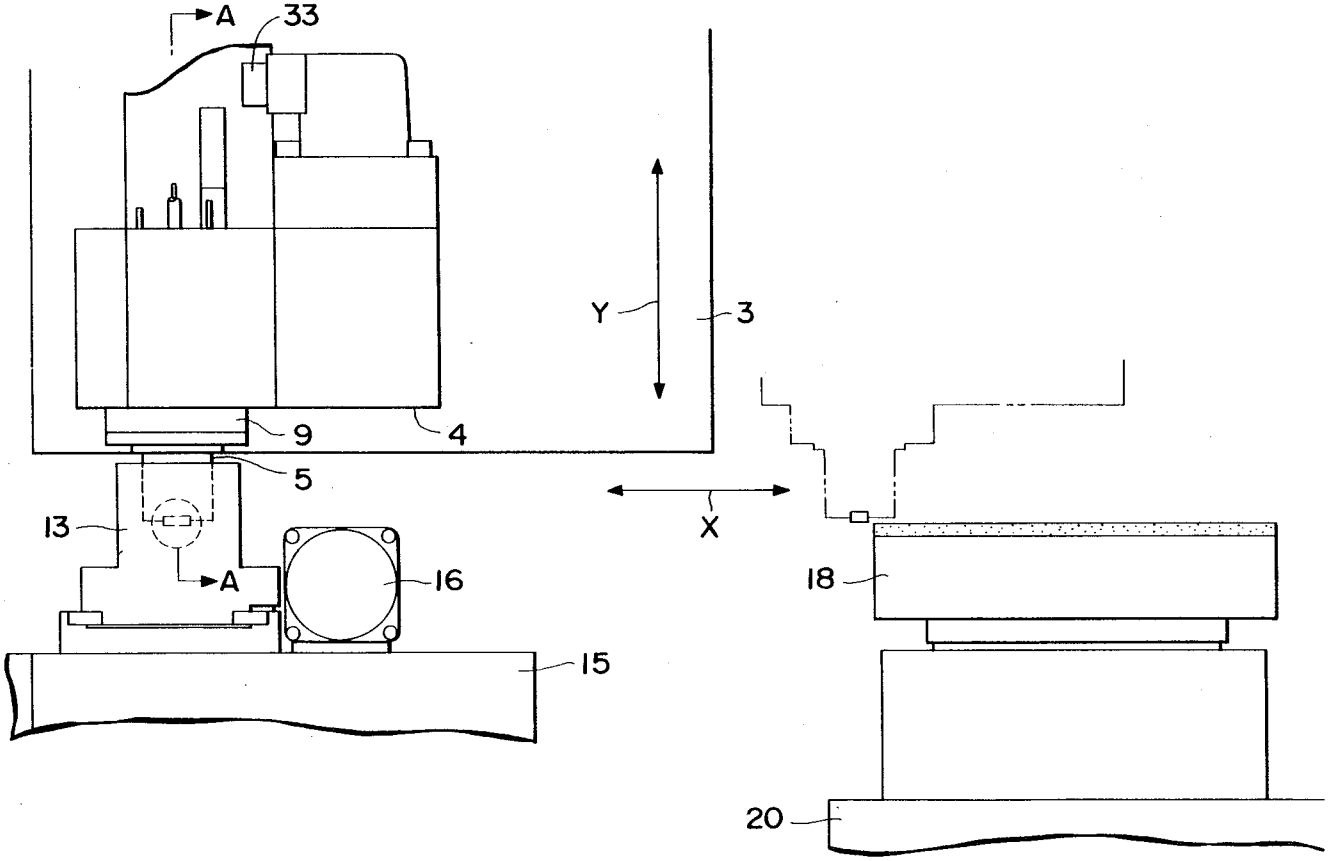
FIG. 4 is a top view of FIG. 3.

FIG. 3 is an enlarged fragmentary side view showing a part of the inclinable jig 4 and the optical detectors in FIG. 1; FIG. 4 is a top view also showing a part of the inclinable jig 4 and the optical detectors; and FIG. 5 is a sectional view showing a section taken from a line A—A of FIG. 4.

Figure 5:
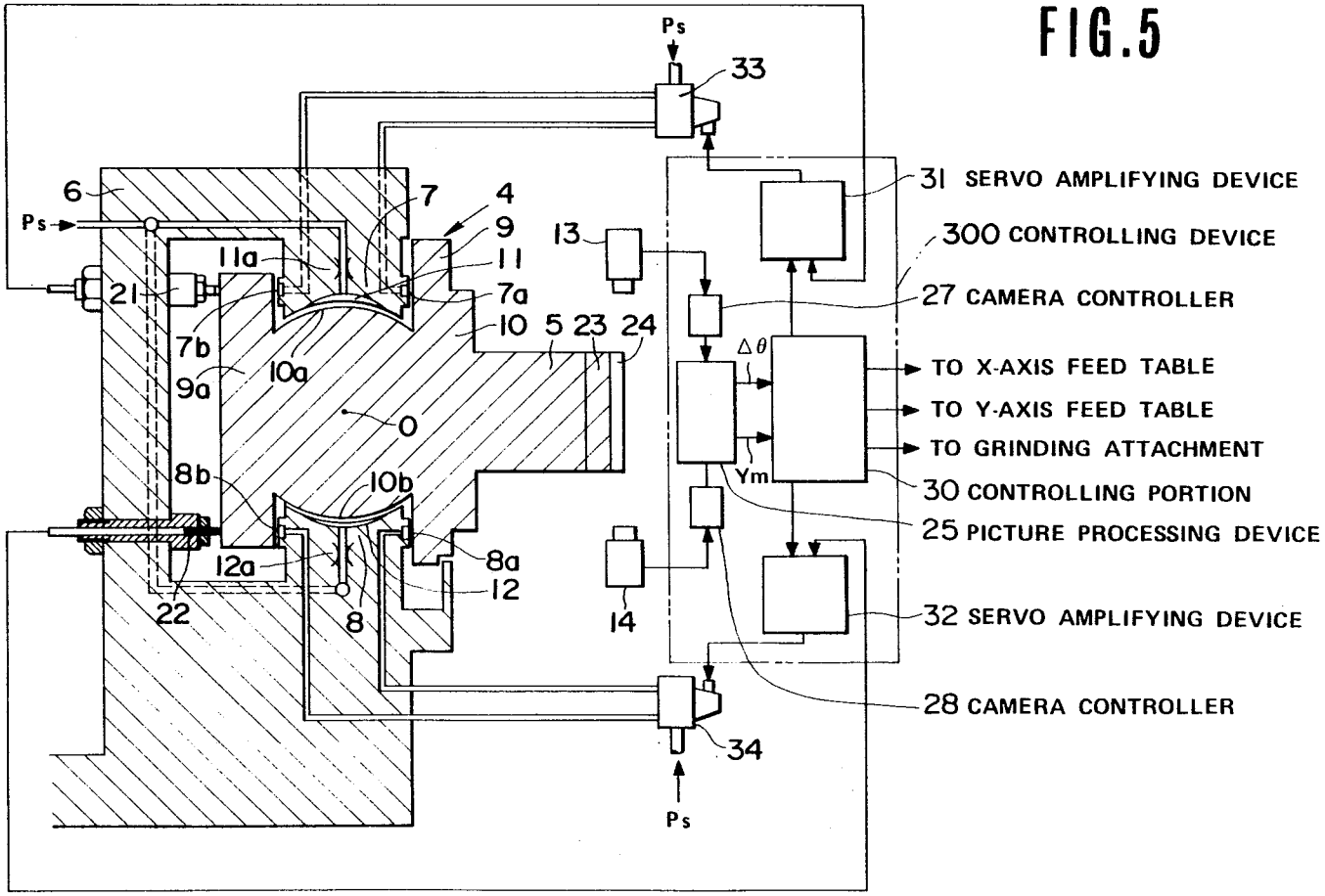
FIG. 5 is a sectional view taken along the line A—A of FIG. 4.

As shown in detail in FIG. 5, the inclinable jig 4 includes a supporting member 6 forming supporting portions 7, 8; and an inclinable member 10 having guide portions 9, 9*a* engage with the supporting portions 7, 8 in such a manner as to sandwich them. The supporting portions 7, 8 include a plurality of channels for supplying a hydrostatic pressure to form pressure pads. The inclinable member 10 is hydrostatically supported by a plurality of hydrostatic pressure pads 11, 12, 7*a*, 7*b*, 8*a* and 8*b*, and amond them the hydrostatic pressure pads 11, 12 are supported equally by a hydraulic fluid at a constant pressure supplied by an exterior supply source (not shown).

If servo valves 33, 34 cause a pressure difference, for example, if $7a > 7b$ and $8a < 8b$, the hydrostatic pressure pads 7*a*, 7*b*, 8*a* and 8*b* rotate counterclockwise on an imaginary axis O in the figure, and, on the other hand, if $7a < 7b$ and $8a > 8b$, they rotate clockwise. The supporting member 6 has displacement detectors 21, 22 at the rear for detecting the angle of inclination of the inclinable member 10. The inclinable member 10 has a vacuum chuck (not shown) at the nose for holding the workpiece 24 by suction.

Figure 6:
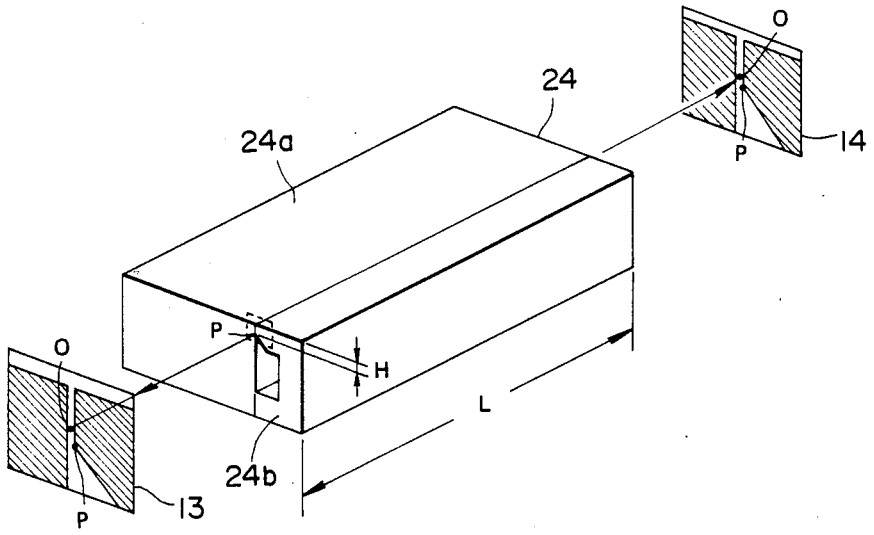
FIG. 6 is a perspective view showing an embodiment of a workpiece.
Figure 7:
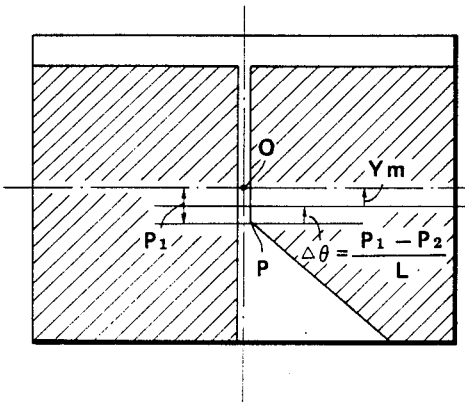
FIG. 7 A–D is an explanatory view of picture displays of upper and lower sides of the workpiece.
Figure 7:
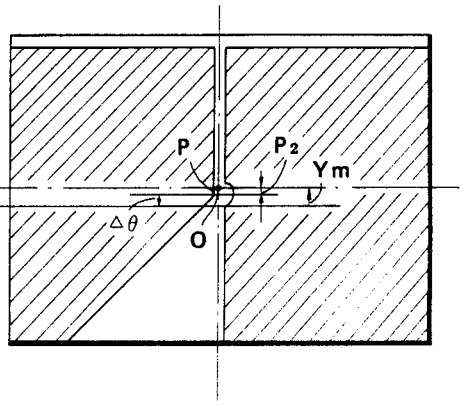
Figure 7:
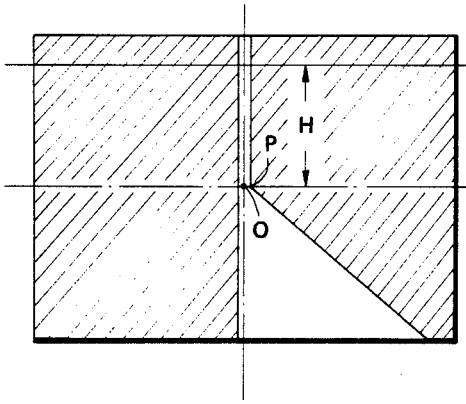
Figure 7:
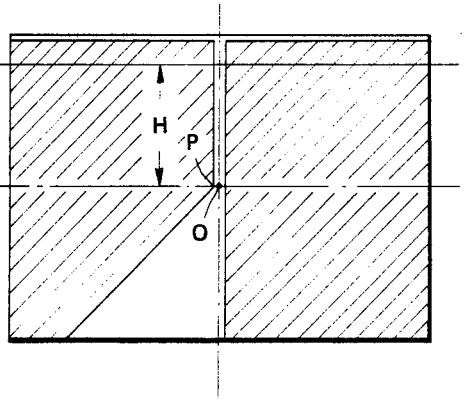

Now the operation of the grinding machine of the invention will be explained with respect to FIGS. 3, 4, 5 and 8. First of all, the X-axis feed table 2 is moved to a workpiece setting position ($O_1$ of FIG. 8) at the right end of FIG. 1, and then the workpiece 24 is held by suction in the vacuum chuck on a workpiece holder of the inclinable jig 4 mounted on the X-axis feed table 2. Next, the X-axis feed table 2 is moved by $X_1$ of FIG. 8 to the position in which TV cameras 13, 14 are located, that is, the measuring position ($O_2$ of FIG. 8) and held at the relative position as shown in FIG. 4. Next, both the TV cameras 13, 14 are approached to each other to take the focus of the workpiece 24. FIG. 6 shows the general configuration of the workpiece 24. The TV cameras 13, 14 project only a part of pictures. FIG. 7 shows viewing angles of the TV cameras 13, 14, wherein FIG. 7 (A) shows a picture of the TV camera 13 and FIG. 7 (B) shows a picture of the TV camera 14. By grinding the surface 24*a*, the height H with respect to the reference position P is finish-ground to the desired level. The configuration in FIG. 6 shows only one side of the reference positions but the opposite side is of the same configuration. Both sides require to be ground at the height H parallel with each of the reference positions P. The TV cameras 13, 14 take and display the pictures of the upper and lower surfaces of the workpiece 24 respectively. Since the workpiece 24 is held much closer to the TV cameras, the pictures are limited to the close vicinity of the reference positions P, as shown in FIG. 7 (A) and FIG. 7 (B). In FIG. 7 (A) and FIG. 7 (B), the reference positions P are usually displaced from the reference lines O of the pictures by $P_1$ and $P_2$ respectively and it is rare that both upper and lower pictures are in agreement with the reference lines O. Therefore, the workpiece 24 is positioned to the reference positions P by controlling the X-axis feed table 2, the Y-axis feed table 3 and the inclinable jig 4. That is to say, in FIG. 5, a picture processing device 25 processes the shading of each of the pictures of the workpiece 24 on the upper and the lower TV cameras 13, 14 given through camera controllers 27, 28, recognizes the configuration, obtains the positions $P_1$, $P_2$ from the reference positions P on the TV cameras 13, 14 by a mathematical process, processes mathematically the difference from the reference lines 0 predetermined on the TV cameras 13, 14, and sends out the outputs to a controlling portion 30 as position signals. With these position signals, the controlling portion 30 obtains signals of the angle of inclination $\Delta\Theta$ and the travel of the Y axis Ym and provides signals. For example, assuming that the position signals are $P_1$ and $P_2$, the signal of angle to be inclined $\Delta\Theta$ is:

$$\Delta\Theta=(P_1-P_2)/L$$

where L = length of workpiece

The travel of the Y axis Ym is:

$$Ym=(P_1+P_2)/2$$

Since the picture processing device 25 of FIG. 5 is well-known as AUTOVISION by AUTOMATIX, etc., the detailed explanation will be omitted herein.

The controlling portion 30 produces voltage signals corresponding to the angle signals $\Delta\Theta$ given by the picture processing device 25, and sends the voltage signals to the respective first input terminals of the servo amplifying devices 31, 32 each including a differential amplifier, gain compensating circuit and servo amplifier. The respective second input terminals of the servo amplifying devices 31, 32 are connected to the respective output terminals of the displacement detectors 21, 22, and the voltage signals corresponding to the inclination of the inclinable member 10 detected by the displacement detectors 21, 22 are fed back to these second input terminals. The servo amplifying devices 31, 32 amplify potential differences applied to the two input terminals and send the corresponding control signals to servo valves 33, 34. The servo valves 33, 34 deliver each supply pressure Ps to each of the hydrostatic pressure pads 7*a*, 7*b*, 8*a* and 8*b* so that the supply pressure Ps becomes the pressure difference corresponding to the control signals provided from the servo amplifying devices 31, 32. On the higher pressure side of the hydrostatic pressure pads, the gap widens. This causes the inclinable member 10 to rotate as mentioned above, thereby resulting in inclination of the workpiece 24. As mentioned above, the inclination of the inclinable member 10 is detected by the displacement detectors 21, 22 and fed back to the servo amplifying devices 31, 32. The servo amplifying devices 31, 32 deliver the control signals to the servo valves 33, 34 until the feedback signals from the displacement detectors 21, 22 almost coincide with the voltage signals from the controlling portion 30. The servo valves 33, 34 supply the inclinable member 10 with the pressure differences corresponding to these control signals and make the inclinable member 10 rotate. Then, when the signals from the displacement detectors almost coincide with the control signals from the controlling portion 30, the inclinable member 10 stops rotating. However, since the servo amplifying devices 31, 32 are adjusted to continue supplying the fixed control signals to the servo valves 33, 34, the servo valves 33, 34 supply pads 7*a*, 7*b*, 8*a* and 8*b* with pressure differences enough to keep that condition. Thus the inclinable member 10 is held in its inclined condition. When positioning is done in this way, pictures FIG. 7 (A) and (B) change to FIG. 7 (C) and (D) respectively. That is to say, by rotating the inclinable jig by $\Delta\Theta=(P_1-P_2)/L$ and moving it along the Y axis by $Ym=(P_1+P_2)/2$, pictures in FIG. 7 (A), (B) become FIG. 7 (C), (D) respectively. At this time, the reference positions P of the workpiece coincide with the reference lines O of the pictures (the reference positions of the pictures are predetermined so as to coincide with the reference positions of the grinding machine).

Figure 8:
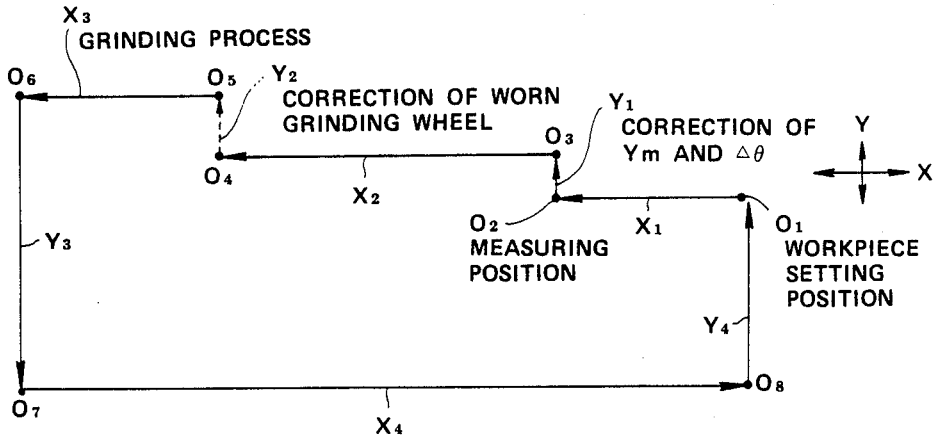
FIG. 8 is a basic sequential view of the grinding machine of the invention.

Next, while the X-axis feed table 2 is moved to the grinding position, the above-mentioned surfaces are ground to the equal height H. In this case, as shown in FIG. 8, it is more effective that the sequence is predetermined so that the Y axis is moved by $Y_2$ in accordance with the wear of the grinding wheel for size control. Next, after grinding operation, the X-axis feed table returns to the workpiece setting position, thus completing all the processes.

FIG. 8 shows one embodiment of the basic automatic operation sequence of the grinding machine of the invention.

As mentioned above, the grinding machine of the invention comprises the picture processing device 25 for calculating the correction rotaty amount of the reference position of the workpiece and the correction travel amount of the Y axis in accordance with the information on the positions of the optical detector; a controlling portion 30 for producing a voltage corresponding to the rotary amount by the signal of the picture processing device 25 and simultaneously providing a fixed drive signal to the X-axis and Y-axis feed tables 2, 3 and the grinding attachment 18; and a controlling device 300 including servo amplifying devices 31, 32 for amplifying the difference between the outputs of the controlling portion 30 and the outputs of the displacement detectors 21, 22 of the inclinable jig 4. Therefore, from the start at the setting position of the workpiece to the return to the original position through position correction process and grinding process, the grinding operation can automatically be accomplished.

As described above, according to the invention, while the reference positions of the workpiece are optically detected and the inclinable jig is controlled, the reference positions of the workpiece are inclined until the reference positions of the workpiece coincide with those of the grinding machine. Thus, since the reference positions and the surfaces being ground can be kept constant, the surfaces can be ground to the size accuracy with respect to the reference positions. This invention provides a grinding with extreme precision.

What is claimed is:

1. A grinding machine comprising:

a grinding attachment for grinding a workpiece;

an optical detector for detecting an inclination and a difference of a reference position of said workpiece with respect to a reference position of the grinding machine;

an inclinable jig for holding said workpiece and capable of inclining the reference position of said workpiece;

moving means for mounting said inclinable jig thereon and capable of traveling between said optical detector and said grinding attachment;

a controlling member for providing a rotary force to said inclinable jig and rotating the same; and a controlling device for sending a control signal to said controlling member and sending other control signals to said moving means and said grinding attachment;

said controlling device calculating a correction amount of the reference position of the workpiece according to the position information from said optical detector, providing the control signal to said controlling member in accordance with the calculated value to rotate and hold said inclinable jig, and traveling said moving means, whereby after the reference position of said workpiece is located and a surface to be ground with respect to the reference position of the workpiece is set, said moving means are traveled and said grinding attachment grinds the workpiece.

2. A grinding machine of claim 1 wherein said moving means comprise an X-axis feed table mounted on a bed, engaged with a hydrostatic guide surface and fed by a hydrostatic feed screw; and a Y-axis feed table engaged with a hydrostatic guide surface provided on said X-axis feed table and fed by a hydrostatic feed screw.

3. A grinding machine of claim 1 wherein said inclinable jig comprises a supporting member fixed on said moving means and an inclinable member rotatably supported on said supporting member by at least a pair of hydrostatic bearings.

4. A grinding machine comprising:

a grinding attachment for grinding a workpiece;

an optical detector for detecting an inclination and a difference of a reference position of said workpiece with respect to a reference position of the grinding machine;

an inclinable jig for holding said workpiece and capable of inclining the reference position of said workpiece;

moving means for mounting said inclinable jig thereon and capable of traveling between said optical detector and said grinding attachment;

a controlling member for providing a rotary force to said inclinable jig and rotating the same;

a controlling device for sending a control signal to said controlling member and sending other control signals to said moving means and said grinding attachment; and a displacement detector for detecting an inclination of said inclinable jig;

said controlling device calculating the correction amount of the reference position of the workpiece according to the position information from said optical detector, providing the control signal to said controlling member in accordance with the calculated value to rotate said inclinable jig, simultaneously receiving the information from said displacement detector for detecting an inclination of said inclinable jig, rotating the inclinable jig until the information from said displacement detector coincides with the calculated value, and holding said jig and traveling said moving means, whereby after the reference position of the workpiece is positioned and the level of the surface to be ground with respect to the reference position of the workpiece is set, said moving means are traveled and said grinding attachment grinds the workpiece.

5. A grinding machine of claim 4 wherein said inclinable jig comprises a supporting member fixed on said moving means and an inclinable member rotatably supported on said supporting member by at least a pair of hydrostatic bearings, said supporting member including a plurality of channels for supplying a hydrostatic pressure, some channels of which being always supplied with a constant pressure to hold hydrostatically said inclinable member, the remaining at least a pair of channels being supplied with a pressure difference corresponding to the difference signal from said controlling device so that the inclinable jig is rotated and held.

6. A grinding machine of claim 4 wherein said controlling member includes a servo valve for supplying the pressure difference corresponding to the control signal from said controlling device.

7. A grinding machine of claim 4 wherein said controlling device comprises a picture processing device for calculating the correction rotary amount of the reference position of the workpiece and the travel amount of the Y-axis in accordance with the position information of the optical detector; a controlling portion for producing a voltage corresponding to said correction rotary amount; and a servo amplifying device for amplifying a difference between the output of said controlling portion and the output of the displacement detector for detecting an inclination of said inclinable jig and for producing the control signal to rotate and hold said inclinable jig.

8. A grinding machine of claim 4 wherein said optical detector includes a microscope and a CCD camera.

9. A grinding machine of claim 4 wherein said moving means comprise an X-axis feed table provided on a bed, engaged with a hydrostatic guide surface and fed by a hydrostatic feed screw; and a Y-axis feed table engaged with a hydrostatic guide surface provided on said X-axis feed table and fed by a hydrostatic feed screw.

* * * * *